US006771918B2

(12) United States Patent
Tatsumi

(10) Patent No.: US 6,771,918 B2
(45) Date of Patent: Aug. 3, 2004

(54) DEVELOPING DEVICE AND IMAGE FORMING DEVICE

(75) Inventor: Kenzo Tatsumi, Kanagawa-Ken (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/247,487

(22) Filed: Sep. 20, 2002

(65) Prior Publication Data

US 2003/0059228 A1 Mar. 27, 2003

(30) Foreign Application Priority Data

Sep. 21, 2001 (JP) ..... 2001-288567

(51) Int. Cl.[7] ..... G03G 15/09
(52) U.S. Cl. ..... 399/103; 399/274
(58) Field of Search ..... 399/103, 260, 399/264, 281, 279, 282, 283, 104, 285, 286, 274, 284, 359

(56) References Cited

U.S. PATENT DOCUMENTS

| | | | | |
|---|---|---|---|---|
| 4,377,334 A | * | 3/1983 | Nishikawa | 399/103 |
| 4,792,831 A | * | 12/1988 | Takeda et al. | 399/284 |
| 5,103,765 A | * | 4/1992 | Owada et al. | 399/103 |
| 5,532,795 A | | 7/1996 | Tatsumi et al. | |
| 5,557,382 A | | 9/1996 | Tatsumi et al. | |
| 5,602,631 A | * | 2/1997 | Sakaguchi | 399/284 |
| 5,678,125 A | | 10/1997 | Kutsuwada et al. | |
| 5,734,953 A | | 3/1998 | Tatsumi | |
| 5,765,079 A | | 6/1998 | Yoshiki et al. | |
| 5,790,929 A | * | 8/1998 | Goto et al. | 399/272 |
| 5,805,965 A | * | 9/1998 | Tsuda et al. | 399/281 |
| 5,815,767 A | | 9/1998 | Kutsuwada et al. | |
| 5,828,935 A | | 10/1998 | Tatsumi et al. | |
| 5,848,343 A | * | 12/1998 | Takahashi et al. | 399/359 |
| 5,887,224 A | | 3/1999 | Mizuishi et al. | |
| 5,915,143 A | | 6/1999 | Watanabe et al. | |
| 6,006,050 A | | 12/1999 | Watanabe et al. | |
| 6,055,388 A | | 4/2000 | Watanabe et al. | |
| 6,085,062 A | | 7/2000 | Mizuishi et al. | |
| 6,128,449 A | | 10/2000 | Zenba et al. | |
| 6,144,811 A | | 11/2000 | Ohori et al. | |
| 6,144,822 A | | 11/2000 | Yamaguchi et al. | |
| 6,148,161 A | | 11/2000 | Usui et al. | |
| 6,160,969 A | | 12/2000 | Ishigaki et al. | |
| 6,266,501 B1 | | 7/2001 | Mizuishi et al. | |

FOREIGN PATENT DOCUMENTS

| | | | |
|---|---|---|---|
| JP | 05-188761 | 7/1993 | |
| JP | 05-197273 | 8/1993 | |
| JP | 05-265329 | 10/1993 | |
| JP | 07295370 A | * 11/1995 | G03G/15/08 |

* cited by examiner

*Primary Examiner*—Arthur T. Grimley
*Assistant Examiner*—Ryan Gleitz
(74) *Attorney, Agent, or Firm*—Oblon, Spivak, McClelland, Maier & Neustadt, P.C.

(57) ABSTRACT

A developing device, used in an image forming device where a developer supported on a developer supporter is thinned by a thinning member, and after being thinned, the developer is adhered to develop a latent image on an image supporter. An adjacent member (a developer scattering blocking member) is disposed at a position adjacent to the thinning member's downstream side in the developer supporter's moving direction, and the adjacent member's thinning member side of the opposite surface that is opposite to the developer supporter and the tip of the thinning member are disposed with an equal distance from the developer supporter. The opposite surface is gradually separated from the developer supporter at the downstream side of the developer supporter's moving direction.

21 Claims, 8 Drawing Sheets

DEVELOPING DEVICE AND IMAGE FORMING DEVICE

CROSS-REFERENCE TO RELATED APPLICATION

This application claims the priority benefit of Japanese application serial no. 2001-288567, filed on Sep. 21, 2001

BACKGROUND OF THE INVENTION

1. Field of the Invention

This invention relates in general to an image forming device, such as a printer, a facsimile, or a multi-function machine with the above functions. More specifically, the invention relates to an image forming device of electrophotographic type where a toner image formed on an image supporter is transferred by charging, optically writing and developing, and then the image is transferred onto a transfer material, such as a sheet or an intermediate transfer material. The present invention also relates to a developing device for developing a latent image on the image supported in such image forming device.

2. Description of Related Art

Conventionally, referring to FIG. 7, an image forming device of electrophotographic type has a developing device using a dry type two-component developer consisting of carrier and toner. The developer contained in the developing case 1 is scratched by the rotation of the paddle 2 to adhere on the developer supporter 3. As the developer supporter 3 rotates, the developer supported thereon is thinned by a thinning member 4. After being thinned, the developer is adhered to develop an electrostatic latent image on the image supporter 5.

In this developing device, a developer scattering blocking member 6 is disposed at a position adjacent to the downstream side of the thinning member 4 in the developer supporter 3's rotational direction B. Entrance seals 7, 8 made of polyurethane, etc. are held on the developer scattering blocking member 6, and an opposite surface 9 is formed opposite to the developer supporter 3.

The developer scattering blocking member 6's opposite surface 9 is receded to a position away from the developer supporter 3's circumferential surface from the thinning member 4's tip, in such a manner without touching the developer on the developer supporter after being thinned by the thinning member 4. Therefore, a step portion s is formed at the tip of the thinning member 4's downstream side in the developer supporter 3's rotational direction B.

For example, as shown in FIG. 8, the developer adhered on the step portion accumulates as t after long time use. This accumulated t portion gets hard in a short time, and falls on the developer supporter due to impact, etc. This causes a problem such that the image formed on the transfer material is distorted.

In order to solve this problem, for example, as disclosed in Japanese Laid Open No. 5-2340 and No. 5-2341, the magnitude or the polarity of the magnetic force of the developer supporter is changed at the downstream and the upstream sides of the thinning member in the developer supporter's rotational direction. However, although it is effective for the toner adhesion on the tip of the thinning member, a sufficient effect cannot be achieved for the toner adhesion on the downstream side's tip or the developer scattering blocking member.

In addition, for example, as disclosed in Japanese Laid Open No. 10-161496, among the napped developer, toner that has small charge amount and contains much paper powder is removed from the napped developer by the centrifugal force caused by the magnetic roller's rotation. However, as the recycled toner amount at the position near the magnetic roller increases, it is normally very difficult to adhere only the charged toner. Foreign articles such as the paper powder are mixed within the napped developer, so that a sufficient effect cannot be achieved.

SUMMARY OF THE INVENTION

According to the foregoing description, the first object of the present invention is that to install a special device such as a paper powder removing device is not required. Without increasing the cost, the toner can be prevented from adhering on the tip of the thinning member's downstream side, and the adhered toner can be prevented from falling on the developing sleeve 28 and reducing the image quality.

According to the second object of the present invention, the toner can be prevented from accumulating on the tip of the thinning member's downstream side covered by the developer scattering blocking member. Therefore, the toner adhered thereon can be prevented from falling on the developer supporter and reducing the image quality.

According to the third object of the present invention, the space between the opposite surface and the developer supporter can be maintained. Even though the toner naps, blocking the developer does not occur. Therefore, after thinned by the thinning member, the toner on the developer supporter is not disturbed, so that it is able to provide a good image.

According to the fourth object of the present invention, due to the toner napping, the toner is transported, while the tip of the napped toner is regularly in contact with the opposite surface of the developer scattering blocking member. Therefore, a cleaning effect can be achieved to prevent the toner from adhering, and it can also prevent the adhered toner from falling on the developing sleeve and reducing the image quality.

According to the fifth object of the present invention, an image forming device with the above developing device is provided to achieve the foregoing objects.

Recently, in the image forming device, in view of environmental protection or the reduction of running cost, a recycling device, which is used for recycling the toner that is not transferred to the transfer material, such as the sheet or the intermediate transfer body to return to the developing device, is generally installed.

In such an image forming device, during the transfer stage, the foreign articles, such as the paper powder, adhered on the image supporter or the intermediate transfer body are mixed with the recycled toner. The mixed paper powder is subject to a lot of mechanical stress from the transporting member, etc., and therefore is shivered into tiny powder before the paper powder return to the developing device. The charge amount of the shivered paper powder is small. As the paper powder that has only small charge amount and cannot be held by the carrier gets accumulates more and more with time in the developer, the toner containing a lot of paper powder scatters and accumulates on the step portion s.

In particular, recently, since users use a lot of paper containing large amount of paper powder such as the recycled paper, the toner containing a lot of paper powder scatters and accumulates much more than ever before, and this accumulated toner gets hard in a short time, and falls on the developer supporter due to impact, etc. This causes a problem such that the image formed on the transfer material is distorted.

According to the sixth object of the present invention, even though in the image forming device equipped with a toner recycling device where foreign articles such as the paper powder are mixed and toner adhesion occurs easily, the toner can be prevented from adhering onto the tip of the developing doctor blade's downstream side or the developer scattering blocking member adjacent to that tip. Therefore, the adhered toner can be prevented from falling on the developing sleeve and reducing the image quality.

According to the objects mentioned above, the present invention provides a developing device, used in an image forming device. In the image forming device, a developer supported on a developer supporter is thinned by a thinning member, and after being thinned, the developer is adhered to develop a latent image on an image supporter. An adjacent member is disposed at a position adjacent to the thinning member's downstream side in the developer supporter's moving direction, the adjacent member's thinning member side of the opposite surface that is opposite to the developer supporter and the tip of the thinning member are disposed with an equal distance from the developer supporter.

In addition, the above developing device can further comprise a developer scattering blocking member, which is used as the adjacent member, disposed to cover the developer supporter to prevent the developer from scattering.

In this developing device, the developer scattering blocking member's opposite surface is gradually separated from the developer supporter at the downstream side of the developer supporter's moving direction.

Moreover, the opposite surface is separated from the developer supporter with an equal distance beyond midway of the downstream side of the developer supporter's moving direction.

Alternatively, the present invention further provides an image device. In this image forming device, the developing device has the aforementioned features.

Furthermore, the above image forming device can further comprise a toner recycling device, for recycling the toner that is not transferred to a transfer material to return to the developing device.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

DESCRIPTION OF THE PREFERRED EMBODIMENT

Figure 1:
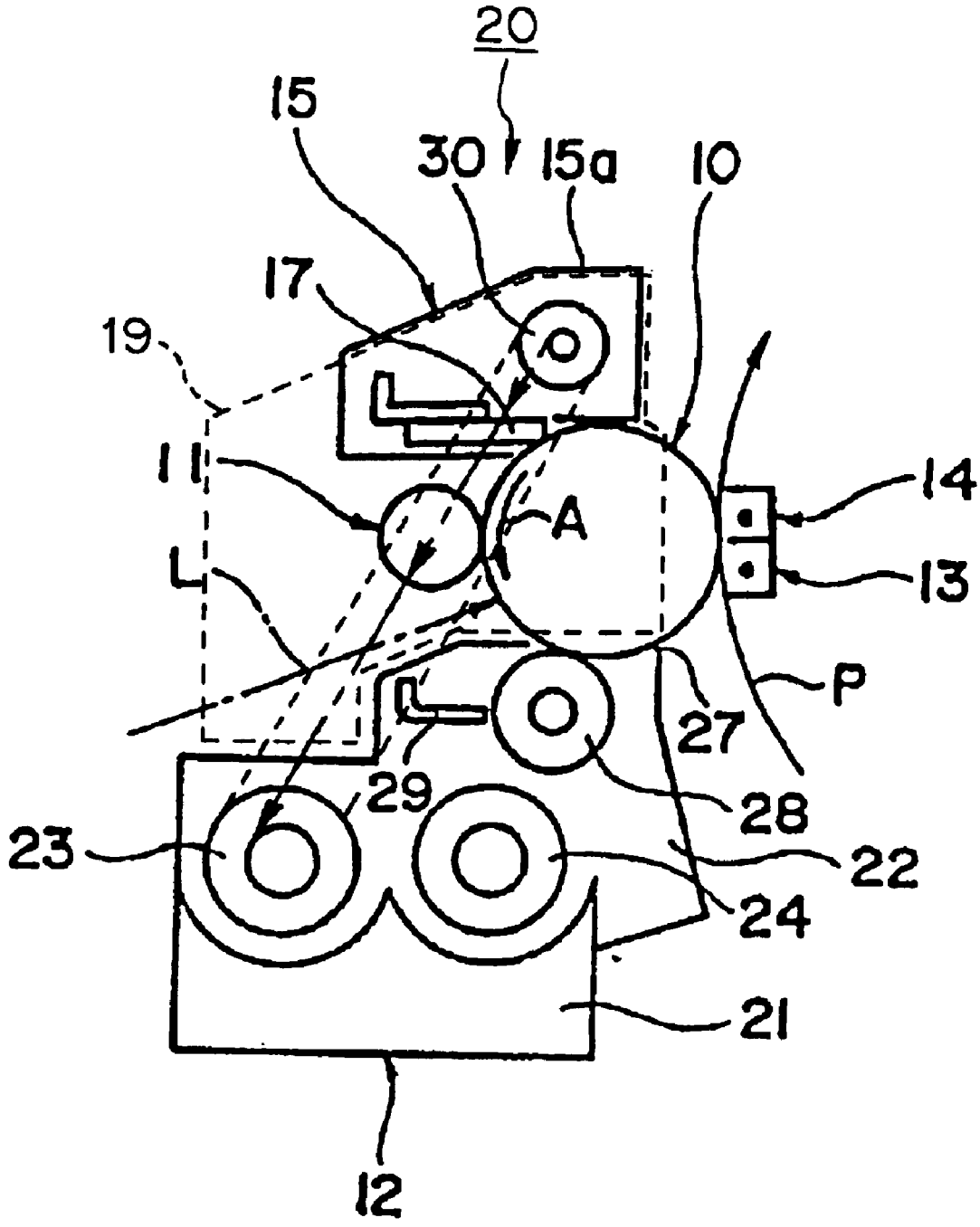
FIG. 1 is a schematic diagram showing the structure of the main part of a laser copying machine.

The preferred embodiment according to the present invention is described in detail accompanying with the attached drawings. FIG. 1 is a schematic diagram showing the structure of the main part of a laser copying machine.

The photoreceptor 10 is a drum-shaped image supporter. In FIG. 1, starting from a charging device that is a roller shape and disposed at a position lateral to the photoreceptor 10, a developing device 12, a transferring device lateral to the photoreceptor 10, and a paper separating device 14, and a cleaning device 15 over the photoreceptor 10 are sequentially disposed around the photoreceptor 10 in a rotational direction indicated by the arrow A When copying, as known to the public, a document is put on a contact glass (not shown), a copy switch is pushed, and the image of the document is then read by an optical reading device (not shown). At the same time, paper (transfer material) P is sent to between the photoreceptor 10 and the transferring device 13.

On the other hand, the surface of the photoreceptor 10 is also charged by the charging device 11 that does not rotate with the photoreceptor 10's rotation, and is irradiated by a laser beam L from the optical reading device (not shown), so that a writing process is performed thereon. An electrostatic latent image of the document image read from the above process is formed on the photoreceptor 10. When passing the developing device 12, the toner is adhered on the photoreceptor 10 to visualize the electrostatic latent image gradually. This toner image formed by the above visualization is transferred by the transferring device 13 to the paper P that is transported to between the photoreceptor 10 and the transferring device 13.

After transfer, the paper P is discharged by the paper separating device 14, separated from the photoreceptor 10 where the paper P is electrostatically adhered thereon, and then transported to a fixing device (not shown) at which the transferred image is fixed. Thereafter, the paper P is ejected to a paper ejecting unit (not shown). In addition, a separating claw can be used to replace the paper separating device 14 to separate the paper P from the photoreceptor 10 mechanically.

On the other hand, after the image is transferred to the paper P, the residual toner remained on the photoreceptor 10's surface is removed by a cleaning blade 17 of the cleaning device 15. After the photoreceptor 10's surface is cleaned up, the photoreceptor 10 is discharged by a discharging lamp to initiate the photoreceptor 10's surface potential.

In the laser copying machine as described above, the developing device 12 comprises a developer container 21 at the lower portion of the device 12 and a developer supporting part 22 at the device 12's upper portion. Dry type two-component developer composed of carrier and toner is contained within the developer container 21. A first stirring unit 23 and a second stirring unit 24 are disposed in the developer container 21 for stirring and transporting the developer. In addition, although not shown in the drawing, a toner concentration sensor for detecting a mixing ratio of the toner and the carrier in the developer is disposed in the developer container 21.

Figure 4:
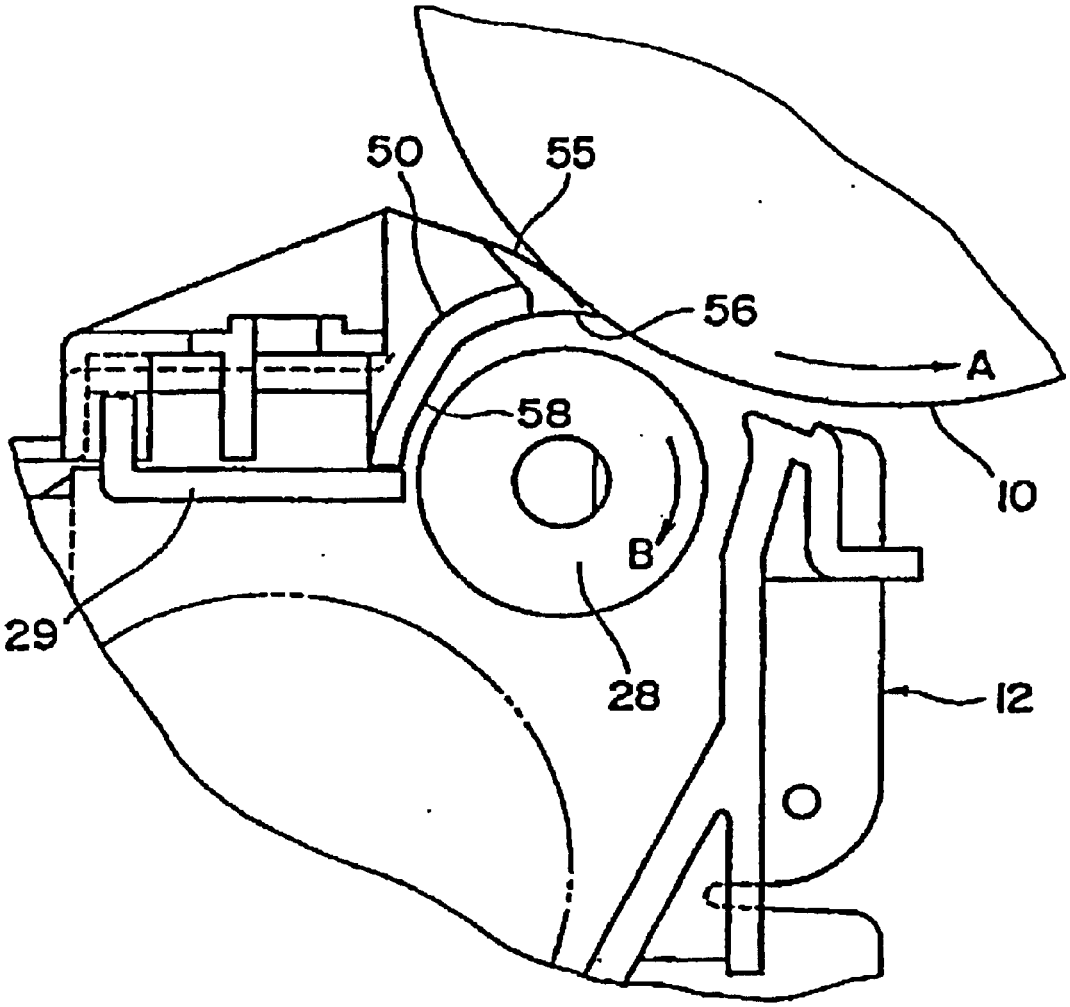
FIG. 4 is an enlarged diagram showing a portion of the developing device of the present invention.

On the other hand, referring to FIG. 4, a developing sleeve (developer supporter) 28 having magnets therein is disposed at a position opposite to the photoreceptor through a developing window 27. In addition, a developing doctor blade (thin member) 29 is installed for controlling the developer's supply amount to the photoreceptor 10.

A screw type toner transporting member 30, which is used for transporting the residual toner removed by the cleaning blade 17 in the cleaning case 15*a* of the cartridge case 19, is disposed in the photoreceptor 10's axial direction within the cleaning device 15 that is located over the photoreceptor 10.

In addition, although not showing in the drawing, a toner recycling device is further disposed for using the transporting member such as a screw coil belt or using gravity to return the toner recovered by the cleaning device 15 passing the transporting passage formed by pipe, etc. to the developer container 21 of the developing device 12.

In the developing device 12, when copying, a driving motor (not shown) is driven to transmit its driving force to make the developing sleeve 28 rotate, and simultaneously, the stirring units 23, 24 are rotated to stir the developer. The developer is transported to the developing sleeve 28, while rubbing to charge the toner and the carrier. On the other hand, a predetermined bias is applied to the developing sleeve 28, and the toner in the developer is electrostatically adhered on the surface of the photoreceptor 10, so that the electrostatic latent image on the photoreceptor 10's surface is visualized.

On the other hand, in the cleaning device, 15, the toner transporting member 30 is rotationally driven by the rotation of the photoreceptor 10 through gears. The residual toner removed from the photoreceptor 10 is transported by the toner transporting member 30, collected at this side in the cleaning case 15*a*, and then brought back to the developing device 12 by the toner recycling device.

Figure 2:
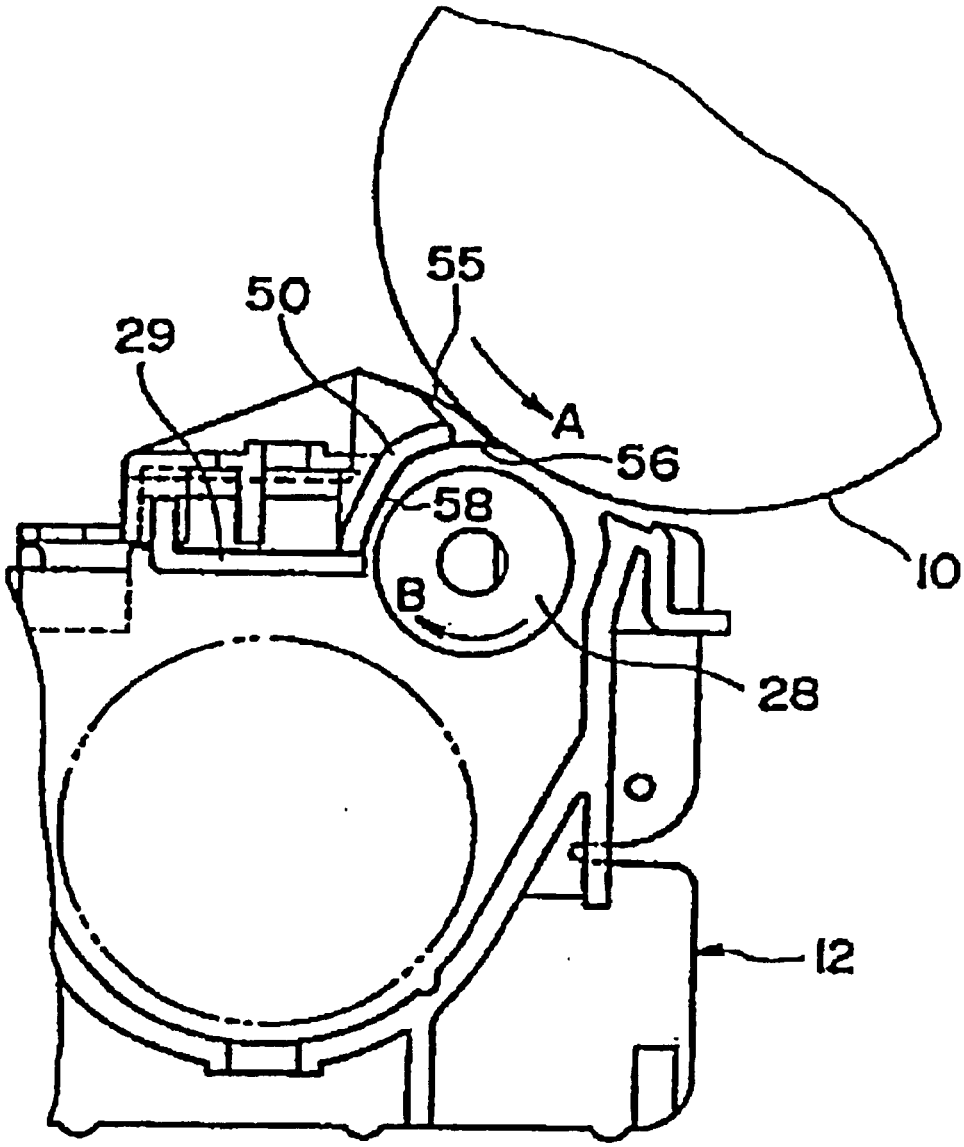
FIG. 2 is an enlarged diagram showing a portion of the developing device having the process cartridge.

FIG. 2 is an enlarged diagram showing a portion of the developing device 12 having the process cartridge 20. As show in FIG. 2, in the developing device 12 of the laser copying machine, the photoreceptor 10 (used as the image supporter) rotates in the arrow direction A (the counterclockwise direction in the drawing), and the developing sleeve 28 (used as the developer supporter) rotates in the arrow direction B (the clockwise direction in the drawing).

The tip of the developing doctor blade 29 (the thin member) is opposite to the developing sleeve 28. The developing doctor blade 29 is an L shape in the cross-sectional profile and is made by bending a base end of a thin metal plate upwards. The developing doctor blade 29 is disposed along the axial direction of the developing sleeve 28, and supported by supporting plates at its two ends.

At the downstream side of the developing doctor blade 29 in the developing sleeve 28's rotational direction B, a developer scattering blocking member 50 is disposed at a position next to the developing doctor blade 29 with a small gap, preferably smaller than 0.5 mm. In this way, the developing sleeve 28 is covered to preventing the developer from scattering.

Figure 3:
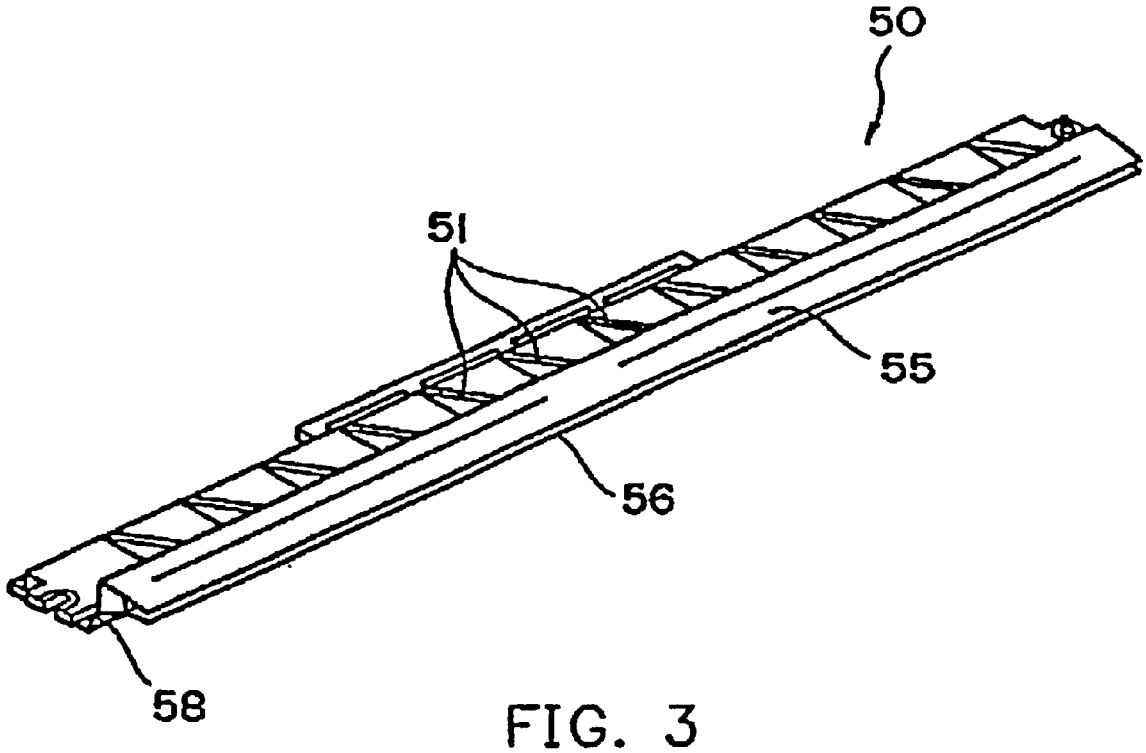
FIG. 3 is a perspective view of the developer scattering blocking member used in the developing device of the present invention.

Referring to FIG. 3, the developer scattering blocking member 50 is reinforced by a plurality of narrow and long reinforcement fins 51. A film-shaped base end of the entrance seal 55 is arranged above one side, and another film-shaped base end of the entrance seal 56 is arranged below one side. The two ends of the developer scattering blocking member 50 are screwed onto the supporting member (not shown) that supports the developing sleeve 28 and the developing doctor blade 29, so that the developer scattering blocking member 50 covers the upper portion of the developing device 12.

Figure 7:
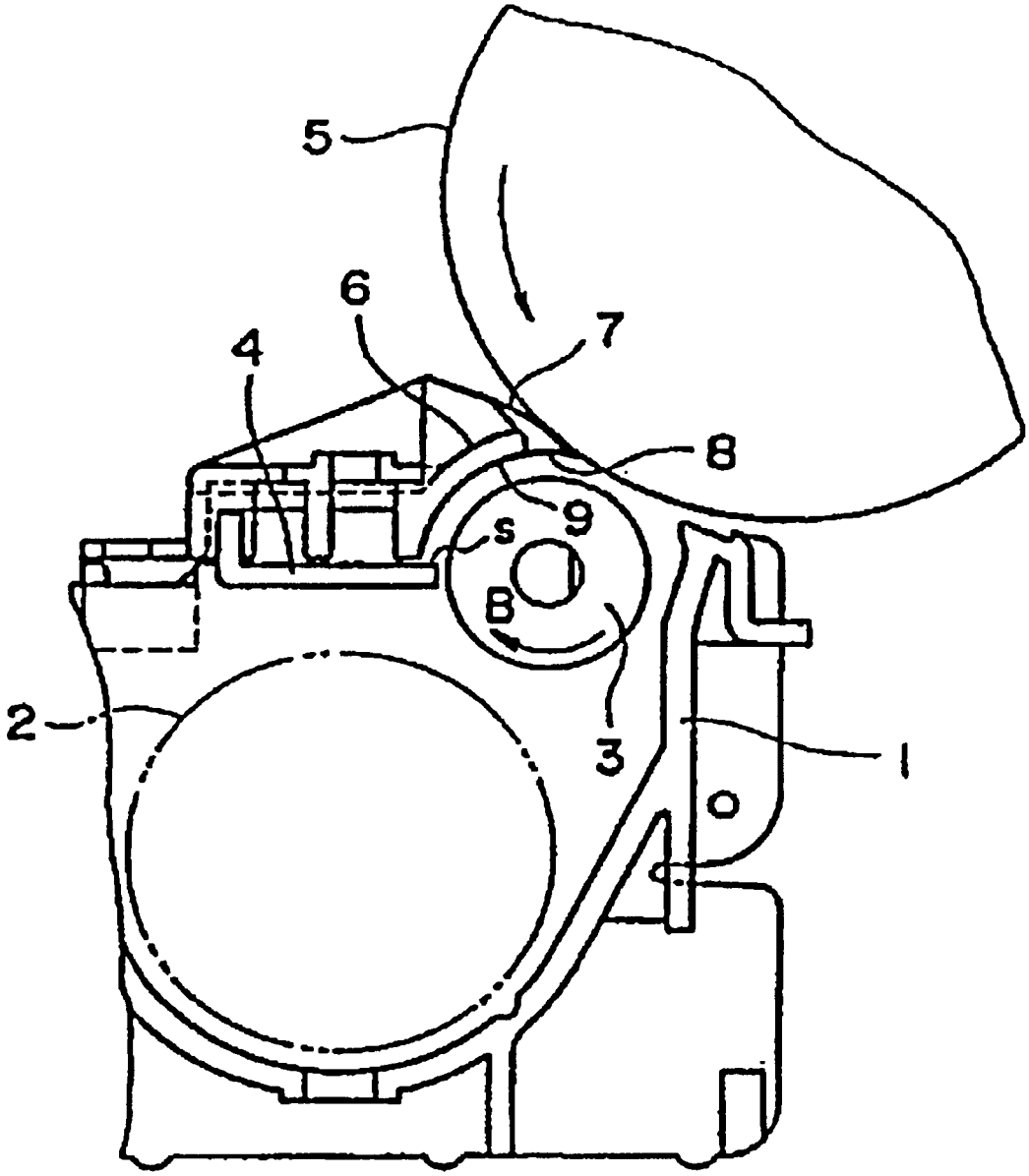
FIG. 7 (PRIOR ART)
FIG. 7 is an enlarged diagram showing a portion of a conventional developing device.
Figure 8:
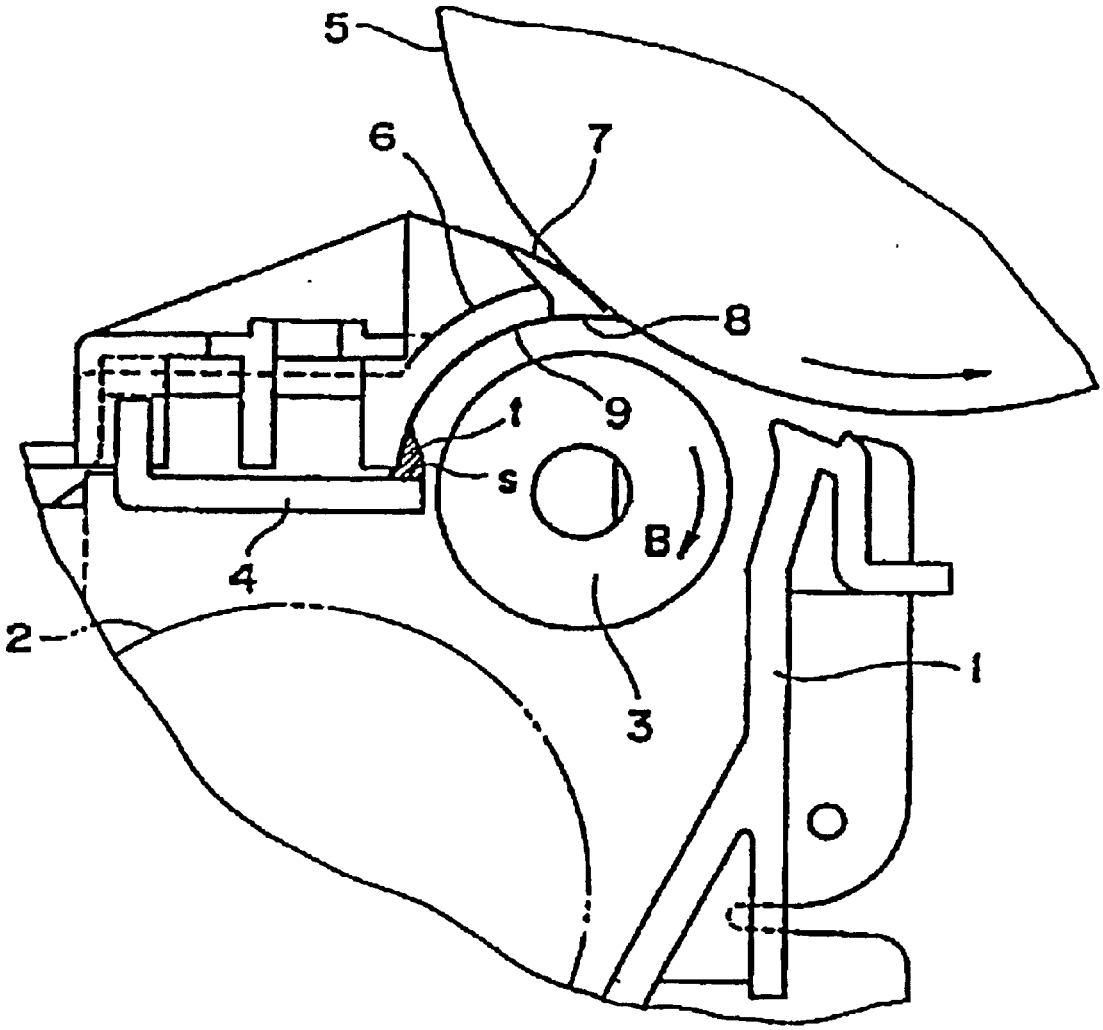
FIG. 8 (PRIOR ART)
FIG. 8 is an another enlarged diagram showing a portion of a conventional developing device.

When the developer scattering blocking member 50 is installed to the developing device 12, the tips of the entrance seals 55, 56 are in contact with the circumferential surface of the photoreceptor 10. In addition, when installing the developing device 12, an opposite surface 58 is formed on a portion opposite to the circumferential surface of the developing sleeve 28. The opposite surface's developing doctor blade 29 side and the tip of the developing doctor blade 29 are disposed with an equal distance from the developing sleeve 28. The tip of the developing doctor blade 29's downstream side in the developing sleeve 28's rotational direction B is completely covered by the developer scattering blocking member 50. Therefore, the conventional step portion s (referring to FIGS. 7 and 8) is not necessary to be formed.

In this way, it is not necessary to install a special device, such as a paper powder removing device, etc. Without increasing the cost, the toner scattered around the developing sleeve 28 can be prevented from adhering and accumulating on the tip of the developing doctor blade 29's downstream side in the developing sleeve 28's rotational direction B. In addition, the adhered toner can be prevented from falling on the developing sleeve 28 and reducing the image quality.

Therefore, by using this structure, the opposite surface's developing doctor blade 29 side and the tip of the developing doctor blade 29 are disposed with an equal distance from the developing sleeve 28. If the gap between the opposite surface 58 and the developing sleeve 28's circumferential surface is kept until the downstream side in the developing sleeve 28's rotational direction B, the space transporting the toner becomes small, so that the developer might be blocked or the entrance seals 55, 56 might be stripped off.

As show in FIG. 4, the opposite surface 58 of the developer scattering blocking member 50 can be disposed at the downstream side of the developing sleeve 28 in the rotational direction B in such a manner that the opposite surface 58 is gradually separated away from the developing sleeve 28.

In this way, the space between the opposite surface 58 and the developing sleeve 28's circumferential surface can be maintained, and even though the toner naps, the blocking of the developer or stripping off the entrance seals 55, 56 do not occur. After being thinned by the developing doctor blade 29, the toner on the developing sleeve 28 is not disturbed, and therefore, a good image can be provided.

In the above developing device 12, as the tip of the standing toner formed on the developing sleeve 28 is in contact with the opposite surface 58, it possesses a cleaning effect to remove the toner adhered on the opposite surface 58. It is preferred that the opposite surface 58 gradually separated from the developing sleeve 28 does not separate from the developing sleeve 28 over a predetermined distance beyond midway of the downstream side of the developing sleeve 28's rotational direction B.

Figure 5:
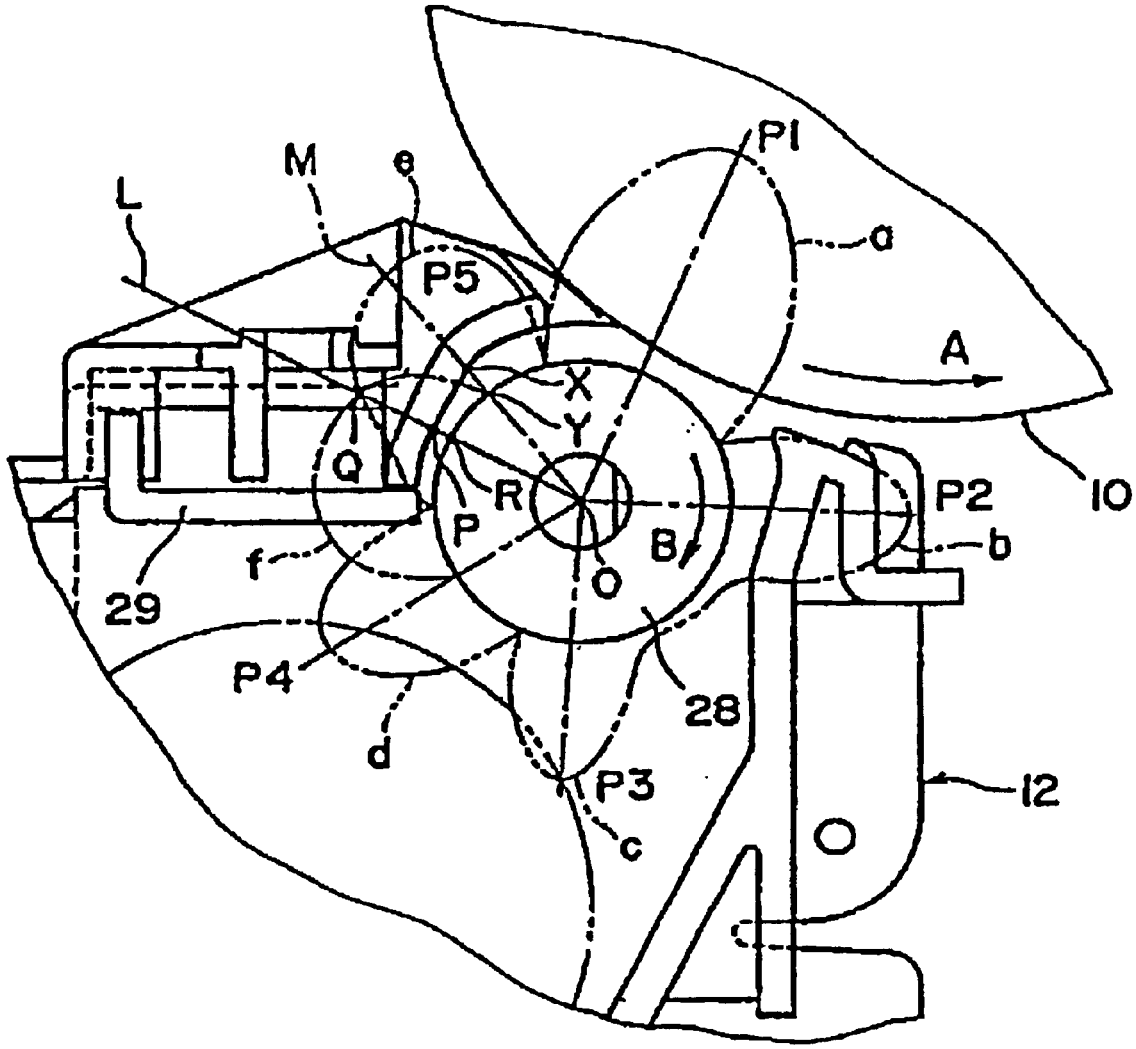
FIG. 5 is a diagram to explain the shape of the opposite surface of the developer scattering blocking member.

As shown in FIG. 5, the distribution curves of the magnetic flux density in the normal directions around the developing sleeve 28 are labeled with a~e. The distribution curve f represents the magnetic flux density in the tangential direction between the developing sleeve 28's developer transporting pole P4 disposed at the upstream side of the developing doctor blade 29 and the developing sleeve 28's developer transporting pole P5 disposed at the downstream of the developing doctor blade 29.

In addition, the intersection point of the distribution curve f and the developer transporting pole P5's distribution curve e is Q. When the line connecting the intersection point Q and the developing sleeve 28's rotational center O is L, the intersection point of the line L and the opposite surface 58 is P, and the intersection point of the line L and the developing sleeve 28's surface is R. In addition, the intersection point of the developer transporting pole P5's normal line M and the opposite surface 58 is X, and the intersection point of the normal line M and the developing sleeve 28's surface is Y.

Figure 6:
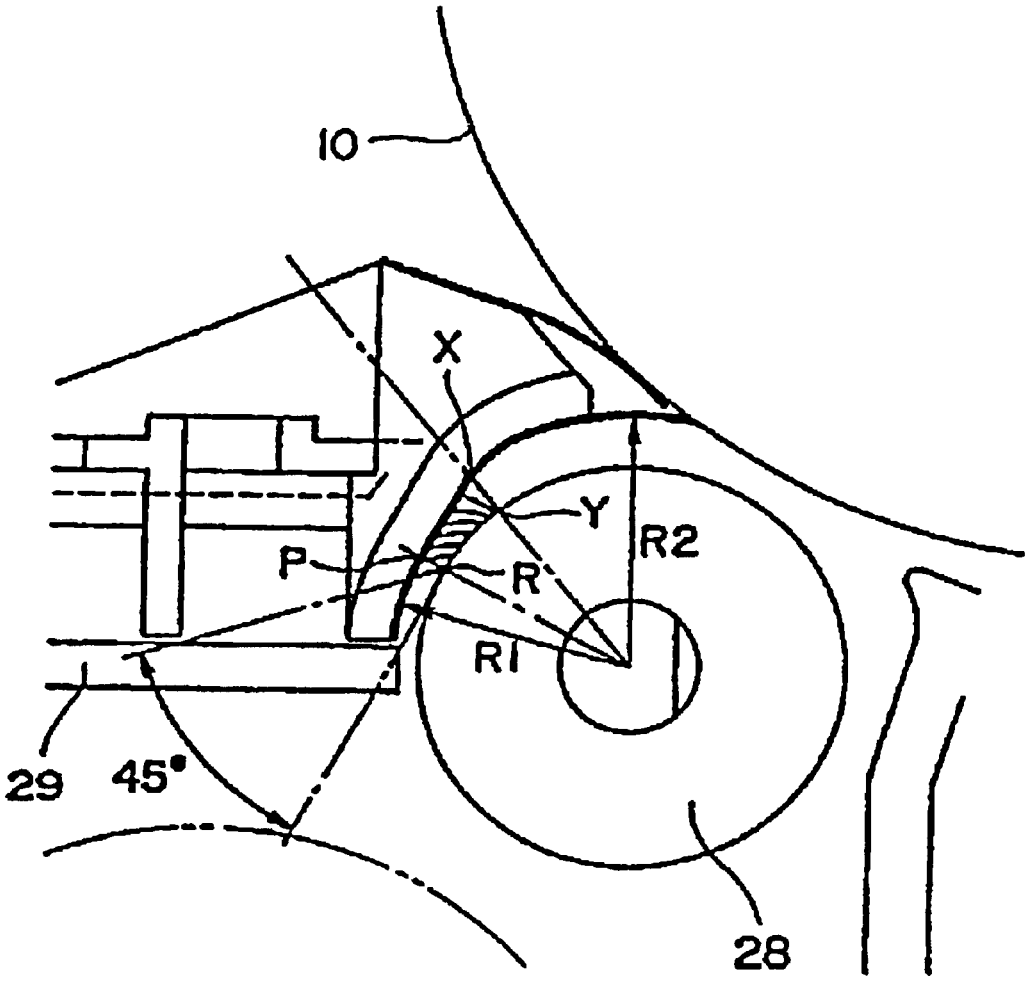
FIG. 6 is an enlarged diagram to explain the toner's napping status.

In the above assumption, as shown in FIG. 6, the toner napping at the intersection point R begins to stand up with a tilt angle of 45° in the tangential direction. After that, the toner napping stands up gradually, and stands up at the intersection point Y with a tilt angle of 90° in the tangential direction.

The position where the opposite surface 58 is adjacent to the developing doctor blade 29 has a radius of R1 centered on the rotational center O. The radius gets larger gradually beyond the intersection point P of the developing sleeve 28's downstream side in the rotational direction B Beyond the intersection point X at the do ream side, the radius becomes R2 larger than R1. Beyond that position, the opposite surface 58 is separated from the developing sleeve 28 with an equal distance.

In this manner, due to the toner napping, the toner is transported, while the tip of the napped toner is regularly in contact with the opposite surface 58 of the, developer scattering blocking member 50, so that a cleaning effect can be achieved to prevent the toner from adhering. In addition, it can also prevent the adhered toner from falling on the developing sleeve 28 and reducing the image quality.

In addition, as shown in the drawings, in the image forming device equipped with a toner recycling device where the foreign articles such as the paper powder are mixed and the toner adhesion occurs easily, the toner can be prevented from adhering onto the tip of the developing doctor blade 29's downstream side or the developer scattering blocking member 50 adjacent to that tip. Therefore, the adhered toner can be prevented from falling on the developing sleeve 28 and reducing the image quality.

As shown in the drawings, in the image forming device equipped with a toner recycling device at which the toner is recycled from the photoreceptor 10's cleaning device 15, the toner can be prevented from adhering onto the developing doctor blade 29 or the developer scattering blocking member 50, so as to avoid the image quality from degrading effectively.

However, the aforementioned structure is not limited to the image forming device as described above. For example, in an image forming device where once the toner image on the image supporter is transferred onto an intermediate transfer body, the toner image is then transferred to a sheet such as transfer paper or OHP film, the invention is also suitable for the image forming device equipped with a toner recycling device at which the toner is recycled from the intermediate transfer body cleaning device.

In summary, in one aspect of the present invention with an adjacent member disposed at a position adjacent to the thinning member's downstream side in the developer supporter's moving direction, the adjacent member's thinning member side of the opposite surface that is opposite to the developer supporter and the tip of the thinning member are disposed with an equal distance from the developer supporter Therefore, no step portion at the tip of the downstream side of the thinning member is required, at which the toner can be prevented from accumulating.

In this way, it is not necessary to install a special device, such a paper powder removing device. Without increasing cost, the toner can be prevented from adhering on the tip of the thinning member's downstream side, and the adhered toner can be prevented from falling on the developing sleeve 28 and reducing the image quality.

In addition, since the developer scattering blocking member, which is used as the adjacent member, is disposed to cover the developer supporter for preventing the developer from scattering, the toner can be prevented from accumulating on the tip of the thinning member's downstream side covered by the developer scattering blocking member. Therefore, the toner adhered thereon can be prevented from falling on the developer supporter and reducing the image quality.

Since the developer scattering blocking member's opposite surface is gradually separated from the developer supporter at the downstream side of the developer supporter's moving direction, the space between the opposite surface and the developer supporter can be maintained. Even though the toner naps, blocking the developer or stripping off the entrance seals do not occur. Therefore, after being thinned by the thinning member, the toner on the developer supporter is not disturbed, so that it is able to provide a good image.

Furthermore, since the opposite surface is separated from the developer supporter with an equal distance beyond midway of the downstream side of the developer supporter's moving direction, due to the toner napping, the toner is transported, while the tip of the napped toner is regularly in contact with the opposite surface of the developer scattering blocking member. Therefore, a cleaning effect can be achieved to prevent the toner from adhering. In addition, it can also prevent the adhered toner from falling on the developing sleeve and reducing the image quality.

According to another aspect of the invention, since the invention can provide an image forming device equipped with the aforementioned developing device, the image forming device of the present invention can also provide the above effects.

Accordingly, even though in the image forming device equipped with a toner recycling device where the foreign articles such as paper powder are mixed and the toner adhesion occurs easily, the toner can be prevented from adhering onto the tip of the developing doctor blade's downstream side or the developer scattering blocking member adjacent to that tip. Therefore, the adhered toner can be prevented from falling on the developing sleeve and reducing the image quality.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What claimed is:

1. A developing device, used in an image forming device where a developer supported on a developer supporter is thinned by a thinning member, and after being thinned, the developer is adhered to develop a latent image on an image supporter, wherein an adjacent member is disposed at a position adjacent to the thinning member's downstream side in the developer supporter's moving direction, and the adjacent member's thinning member side of an opposite surface that is opposite to the developer supporter and a tip of the thinning member are disposed with an equal distance from the developer supporter, and a portion of the opposite surface is disposed a greater distance from the developer supporter than the tip from the developer supporter.

2. The developing device of claim 1, further comprising a developer scattering blocking member, which is used as the adjacent member, disposed to cover the developer supporter for preventing the developer from scattering.

3. A developing device, used in an image forming device where a developer supported on a developer supporter is thinned by a thinning member, and after being thinned, the developer is adhered to develop a latent image on an image supporter, wherein an adjacent member is disposed at a position adjacent to the thinning member's downstream side in the developer supporter's moving direction, and the adjacent member's thinning member side of an opposite surface that is opposite to the developer supporter and a tip of the thinning member are disposed with an equal distance from the developer supporter, wherein a developer scattering blocking member is used as the adjacent member and is disposed to cover the developer supporter for preventing the developer from scattering, and wherein the developer scattering blocking member's opposite surface is gradually separated from the developer supporter with a varied curvature radius at the downstream side of the developer supporter's moving direction.

4. The developing device of claim 3, wherein the opposite surface is separated from the developer supporter with an equal distance beyond midway of the downstream side of the developer supporter's moving direction.

5. An image forming device, comprising at least a developing device, used in the image forming device where a developer supported on a developer supporter is thinned by a thinning member, and after being thinned, the developer is adhered to develop a latent image on an image supporter, wherein an adjacent member is disposed at a position adjacent to the thinning member's downstream side in the developer supporter's moving direction, and the adjacent member's thinning member side of an opposite surface that is opposite to the developer supporter and a tip of the thinning member are disposed with an equal distance from the developer supporter, and a portion of the opposite surface is disposed a greater distance from the developer supporter than the tip from the developer supporter.

6. The image device of claim 5, further comprising a developer scattering blocking member, which is used as the adjacent member, disposed to cover the developer supporter for preventing the developer from scattering.

7. An image forming device, comprising at least a developing device, used in the image forming device where a developer supported on a developer supporter is thinned by a thinning member, and after being thinned, the developer is adhered to develop a latent image on an image supporter, wherein an adjacent member is disposed at a position adjacent to the thinning member's downstream side in the developer supporter's moving direction, and the adjacent member's thinning member side of an opposite surface that is opposite to the developer supporter and a tip of the thinning member are disposed with an equal distance from the developer supporter, and wherein a developer scattering blocking member is used as the adjacent member and is disposed to cover the developer supporter for preventing the developer from scattering.

8. The image device of claim 7, wherein the opposite surface is separated from the developer supporter with an equal distance beyond midway of the downstream side of the developer supporter's moving direction.

9. The image device of claim 5, further comprising a toner recycling device, for recycling the toner that is not transferred to a transfer material to return to the developing device.

10. A developing device, used in an image forming device where a developer supported on a developer supporter is thinned by a thinning member, and after being thinned, the developer is adhered to develop a latent image on an image supporter, wherein an adjacent member is disposed at a position adjacent to the thinning member's downstream side in the developer supporter's moving direction, and the adjacent member's thinning member side of the opposite surface that is opposite to the developer supporter and the tip of the thinning member are disposed with an equal distance from the developer supporter, and wherein an opposite surface of the adjacent member is separated from the developer supporter with an equal distance beyond midway of the downstream side of the developer supporter's moving direction.

11. An image forming device, comprising at least a developing device, used in the image forming device where a developer supported on a developer supporter is thinned by a thinning member, and after being thinned, the developer is adhered to develop a latent image on an image supporter, wherein an adjacent member is disposed at a position adjacent to the thinning member's downstream side in the developer supporter's moving direction, and the adjacent member's thinning member side of the opposite surface that is opposite to the developer supporter and the tip of the thinning member are disposed with an equal distance from the developer supporter, and wherein an opposite surface of the adjacent member is separated from the developer supporter with an equal distance beyond midway of the downstream side of the developer supporter's moving direction.

12. A developing device for use in an image forming device, comprising:

a developer supporter having a developer surface adapted to receive a developer;

a thinning member having a tip disposed a first distance from the developer surface, the thinning member adapted to thin the developer received on the developer surface; and an adjacent member having a member surface facing the developer surface, the member surface including first and second portions, the first portion disposed the first distance from the developer surface, and the second portion disposed a second distance from the developer surface that is greater that the first distance, the adjacent member disposed downstream of the thinning member in a direction of rotation of the developer supporter.

13. The developing device according to claim 12, wherein the adjacent member comprises an arcuate cross-section.

14. The developing device according to claim 12, wherein the second portion of the adjacent member is disposed downstream of the first portion of the adjacent member.

15. The developing device according to claim 12, wherein the first portion of the adjacent member is disposed closer to the thinning member than the second portion of the adjacent member.

16. The developing device according to claim 12, wherein the thinning member comprises a blade.

17. An image forming device, comprising:

an image forming device adapted to form a latent image; and a developing device, the developing device comprising:

a developer supporter having a developer surface adapted to receive a developer;

a thinning member having a tip disposed a first distance from the developer surface, the thinning member adapted to thin the developer received on the developer surface; and an adjacent member having a member surface facing the developer surface, the member surface including first and second portions, the first portion disposed the first distance from the developer surface, and the second portion disposed a second distance from the developer surface that is greater that the first distance, the adjacent member disposed downstream of the thinning member in a direction of rotation of the developer supporter.

18. The image forming device according to claim 17, wherein the adjacent member comprises an arcuate cross-section.

19. The image forming device according to claim 17, wherein the second portion of the adjacent member is disposed downstream of the first portion of the adjacent member.

20. The image forming device according to claim 17, wherein the first portion of the adjacent member is disposed closer to the thinning member than the second portion of the adjacent member.

21. The image forming device according to claim 17, wherein the thinning member comprises a blade.

* * * * *